US005803763A

United States Patent [19]

Grant

[11] Patent Number: 5,803,763

[45] Date of Patent: Sep. 8, 1998

[54] BULKHEAD/IN-LINE SEALED CONNECTION SYSTEM

[75] Inventor: Mark S. Grant, Livonia, Mich.

[73] Assignee: Yazaki Corporation, Tokyo, Japan

[21] Appl. No.: 735,173

[22] Filed: Oct. 22, 1996

[51] Int. Cl.[6] ..... H01R 13/627

[52] U.S. Cl. ..... 439/364; 439/559

[58] Field of Search ..... 439/359, 362, 439/364, 559, 587, 271, 701

[56] References Cited

U.S. PATENT DOCUMENTS 4,684,190 8/1987 Clark et al. ..... 439/559
5,139,431 8/1992 Saitoh et al. ..... 439/364
5,266,047 11/1993 Black et al. ..... 439/364
5,328,388 7/1994 Fust et al. ..... 439/364
5,393,242 2/1995 VanDerStuyf ..... 439/364

*Primary Examiner*—Hien Vu
*Attorney, Agent, or Firm*—Young & Basile, P.C.

[57] ABSTRACT

An interchangeable modular electrical connector for in-line and bulkhead applications within automobiles. The selection of male and female terminal housings and seals is identical for both the in-line and bulkhead applications, and the female housing is provided with bulkhead securing structure which remains unused and out of the way for in-line connections. Only the male housing cover is specific to each application; however, the in-line and bulkhead male housing covers are interchangeable on the male housing.

6 Claims, 4 Drawing Sheets

BULKHEAD/IN-LINE SEALED CONNECTION SYSTEM

BACKGROUND OF THE INVENTION

This invention relates in general to sealed electrical connectors of the type used for automotive wiring in bulkhead and in-line wiring applications.

DESCRIPTION OF THE RELATED ART

In automotive wiring applications there are two different types of electrical connectors known as "in-line" connectors (FIG. 1) and "bulkhead" connectors (FIG. 2). A bulkhead electrical connector is used, for example, on opposite sides of a body panel or firewall. An in-line electrical connector is used to connect electrical wiring in end-to-end fashion, often with a minimal profile so that the connected wiring can be positioned or fastened out of the way.

Because electrical wiring in an automobile is often exposed to the elements, these electrical connectors must provide sealed protection in addition to secure electrical connection. As shown in FIGS. 1 and 2, electrical connection is obtained by joining male terminal housings 200, 210 with female terminal housings 201, 211.

With the in-line electrical connector of FIG. 1 a protective seal is established by installing cover 202 and seal 203 on the male terminal housing and cover 204 and seal 205 on the female terminal housing, after the male terminal housing 200 and female terminal housing 201 have been interconnected.

In the bulkhead application of FIG. 2, the male terminal housing 210 is located on a side of the automobile body panel 214 exposed to an environment which requires the connector and bulkhead aperture to be sealed on that side. Male housing 210 is interconnected through the bulkhead aperture with female terminal housing 211 located on the opposite side of the body panel 214. All seals in the prior art bulkhead connector are associated with the male housing: the junction of the male housing 210 and male cover 212 are sealed by seal 213; the junction of the male housing 210 and bulkhead 214 is sealed by seal 215 on the male housing, compressed against the body panel 214 as the male and female terminal housings 210, 211 are connected.

Although the in-line and bulkhead connectors provide a broadly similar function, they are quite different in terms of parts and sealing connections. The male terminal housing 210 of the bulkhead application is much larger than the in-line male terminal housing 200. The female terminal housing 211 for the bulkhead connector is larger than the in-line female terminal housing 201. Additionally, the cover assemblies and seals are unique for each application. Consequently, the male and female housings, the cover assemblies and the seals of the bulkhead and in-line connectors are not interchangeable. This has resulted in a doubling of manufacturing, purchasing, and tooling, and requires dual component bins during product assembly, thereby increasing cost and effort.

SUMMARY OF THE INVENTION

The present invention provides an electrical connector system that can be used for both in-line and bulkhead applications with minimal modification. With this modular, interchangeable connector system, the same male housing, female housing, and seals can be used for both the bulkhead and in-line applications; only the male cover assembly remains unique to each application. Specifically, in the bulkhead application, a male cover assembly which seals against the automobile panel is used in place of the in-line cover assembly. However, the bulkhead uses the same male-side wire seals as the in-line male cover.

In one embodiment, the connector system comprises a female terminal housing; a male terminal housing; an in-line male cover; a bulkhead male cover; a housing interface seal; and a bolt for securing the components together in bulk-head and in-line applications.

This inventive connector system greatly reduces the need for different manufacturing processes, the stocking of different component parts, and the requirement for different tooling for bulkhead and in-line connectors. This in turn reduces both cost and assembly time.

BRIEF DESCRIPTION OF THE DRAWINGS

This invention, together with other objects, features, aspects and advantages thereof, will be more clearly understood from the following description, considered with the accompanying drawings.

DESCRIPTION OF THE PREFERRED EMBODIMENT

Figure 2:
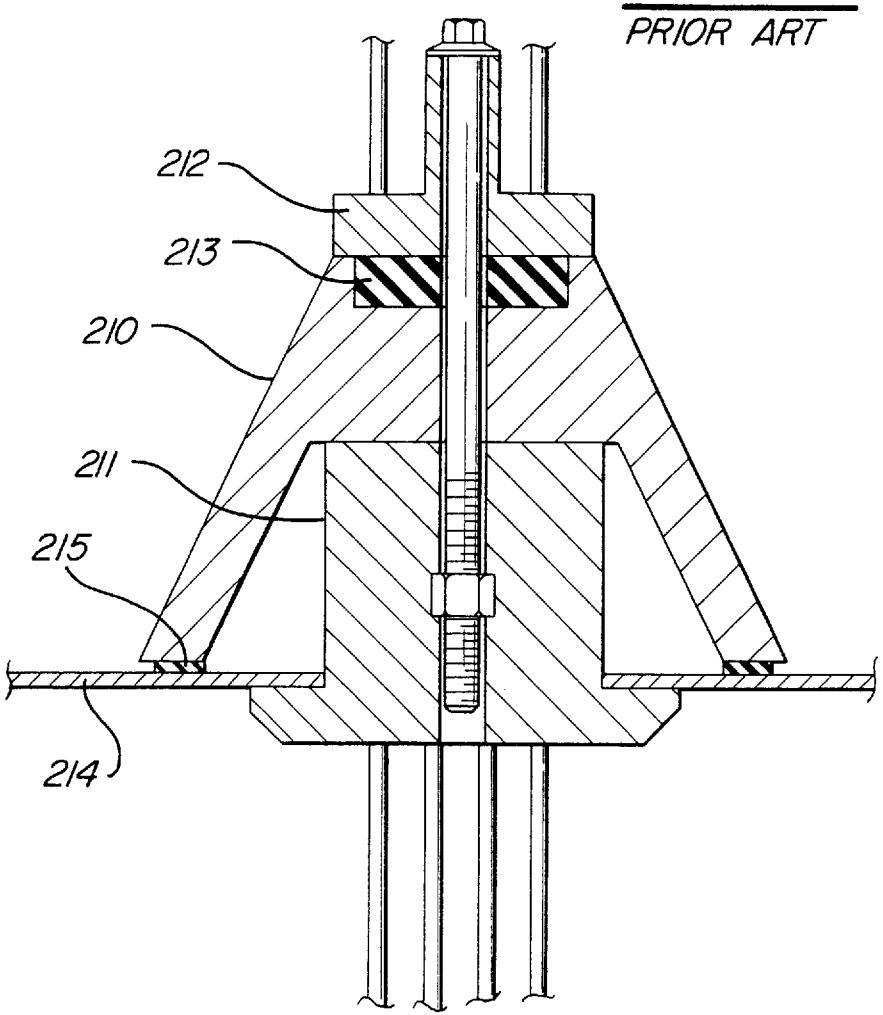
FIG-2 PRIOR ART
FIG. 2 is a cross-sectional side view of a prior art bulkhead connector assembly.
Figure 1:
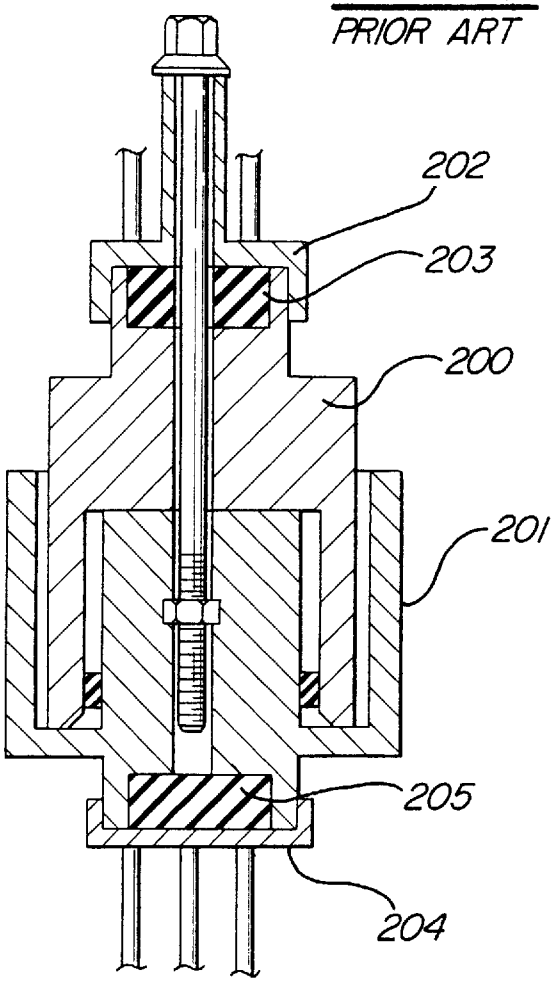
FIG-1 PRIOR ART
FIG. 1 is a cross-sectional side view of a prior art in-line connector assembly.
Figure 3:
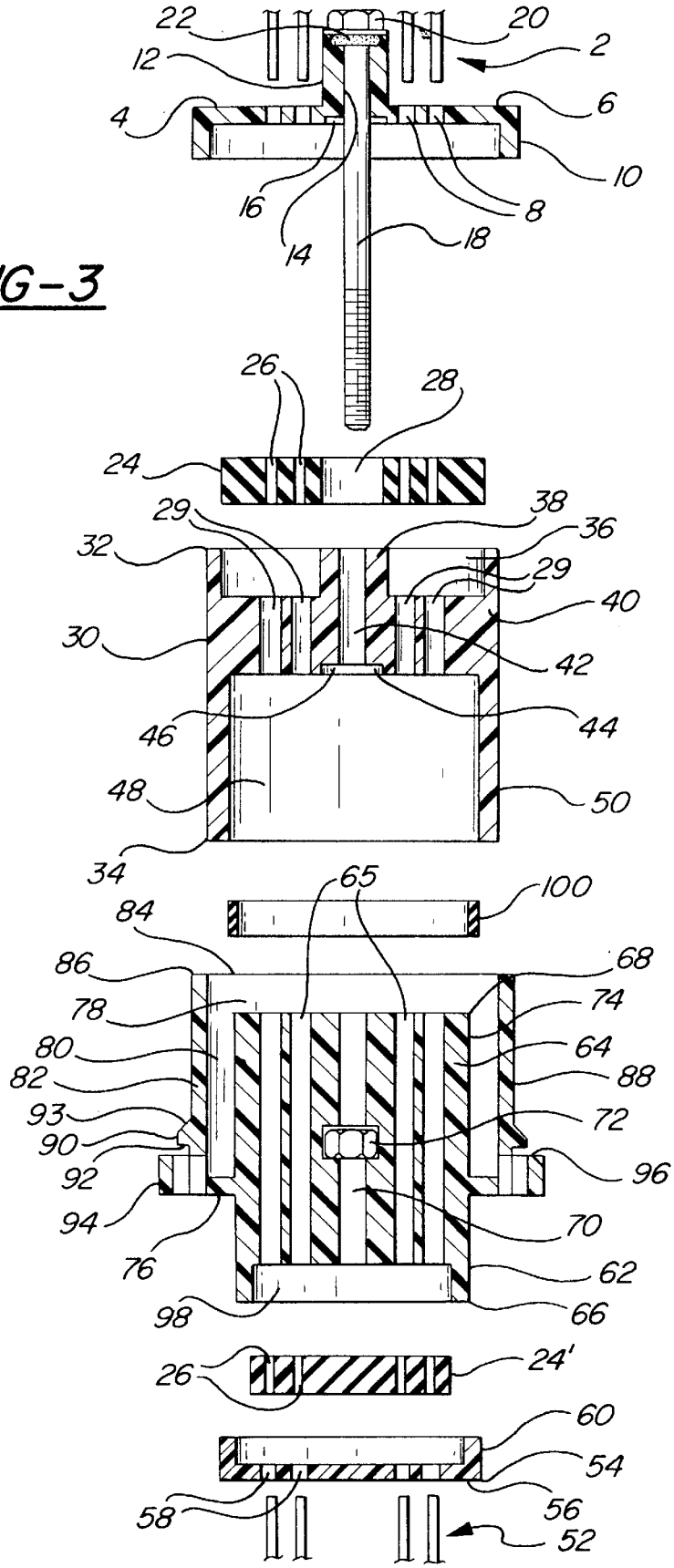
FIG. 3 is a cross-sectional exploded side view of an in-line connector assembly according to the invention.

Referring now to FIG. 3, the parts of an in-line connector according to the present invention are illustrated. A set of electrical wires 2 terminates on the male terminal housing side of the connector. The wires 2 are provided with electrical terminals of known type (not shown) on their ends.

For ease of explanation, ends of the connector system components will be referred to as "upper" or "lower" ends, the frame of reference being the arbitrary orientation of the drawings rather than any real-life orientation requirements.

The wires 2 pass through passages 8 in the upper surface 6 of a male cover 4. Male cover 4 includes a downwardly-turned circumferential rim 10, and a cylindrical bolt sleeve 12 extending upwardly from the center of the cover and having a bolt aperture 14. A depression on the underside of the male cover receives a lock washer 16 to secure a bolt 18 to the cover 4. The bolt's head 20 is seated against the upper end of the sleeve 12 with an O-ring 22 sandwiched between the bolt head 20 and sleeve 12 to seal the aperture 14.

A male terminal wire seal 24 made of a suitable known sealing material fits within cover 4, and includes passages 26 for wires 2 and a central aperture 28 for bolt 18. Passages 26 in wire seal 24 align themselves with passages 8 in cover assembly 4 when they are assembled.

The next piece in the connector assembly is a male terminal housing 30 with an upper end 32 and a lower end 34. Housing 30 includes wire passages 29 and terminal accommodating chambers of known type (not shown) for receiving and holding the terminals on the ends of wires 2.

A seal cavity 36 in the upper end of housing 30 is sized to receive wire seal 24. The central bolt aperture 28 in wire seal 24 fits over a seal-mounting plug 38 within cavity 36. Plug 38 protrudes upwardly from a transverse body portion 40 in housing 30, with bolt throughbore 42 extending completely therethrough. A depression 44 formed around the lower end of throughbore 42 in body portion 40 receives another lock washer 46 to further secure bolt 18, cover assembly 4, wire seal 24 and housing 30 as a unit.

The body portion 40 in male housing 30 separates upper cavity 36 from a second, larger cavity 48 opening on the lower end 34 of housing 30. Throughbore 42 communicates with lower cavity 48. Male housing 30 terminates with a circumferential sidewall 50 surrounding lower cavity 48.

Male cover 4 fits snugly over upper end 32 of housing 30 with seal 24 sandwiched therebetween to seal all gaps between the wires and their passages through the male cover and male housing.

Still referring to FIG. 3, a second set of electrical wires 52 terminates at the female terminal housing side of the connector. Like male-side wires 2, wires 52 have terminals of known type (not shown) on their ends. This female half of the in-line connector assembly includes a female cover 54 with wire passages 58 through its outer surface 56. A flange 60 extends around the outer edge of cover 54 toward a female terminal housing 62.

The female terminal housing 62 has a body portion 64 with a lower end 66 and an upper end 68. The body portion 64 includes terminal accommodating chambers of known type (not shown) in wire passages 65, into which the terminals on the ends of wires 52 are inserted and held. A central throughbore 70 extends through body portion 64 to hold a nut 72 captive within its length. Throughbore 70 receives the threaded end of bolt 18 which engages nut 72 in threaded connection.

The interior body portion 64 of the female terminal housing has an outer surface 74 with a transverse shoulder or stop 76. Shoulder 76 is the base of an outer sidewall 78 extending from shoulder 76 up and around upper end 68 of body portion 64 to define a slot 80 formed around body portion 64 over a substantial part of its length. Sidewall 78 includes at least two exterior lock arms 82 attached to sidewall 78 at upper end 84 adjacent upper end 68 of interior body portion 64. Each lock arm 82 has a hinged end 86 (where the lock arm is attached to sidewall 78) and a free end 88 spaced from sidewall 78. The hinged end 86 may be integral with sidewall 78 or connected to sidewall 78 in some other conventional manner. The free end 88 of lock arm 82 extends to a point adjacent shoulder 76.

The free end 88 of each lock arm 82 has an outward projection 90 with a flat contact surface 92 extending substantially perpendicular to sidewall 78. A slanted cam surface 93 is angled from the outer edge of projection 90 back toward lock arm 82.

Exterior support tabs 94 extend from sidewall 78 adjacent the free end 88 of each lock arm 82. The tabs 94 have bulkhead contact surfaces 96 substantially parallel to but spaced from contact surfaces 92 on projections 90 of the free ends 88 of lock arms 82.

The lower end 66 of body portion 64 of female terminal housing 62 has a cavity 98 sized to receive a female-side wire seal 24'. Female cover 54 is sized to snugly fit over and around the lower end 66 of body portion 64. A conventional latch mechanism (not shown) on female cover 54 and body portion 64 can be used to secure cover 54 to female terminal housing 62. The passages 58 in female cover 54 are aligned with passages 26 in male cover 4 when the in-line connector is assembled.

A terminal housing interface seal 100, made of a sealing material such as silicone, is inserted in slot 80 between sidewall 78 and body portion 64 of the female terminal housing 62 prior to mating female housing 62 with male terminal housing 30.

Figure 4:
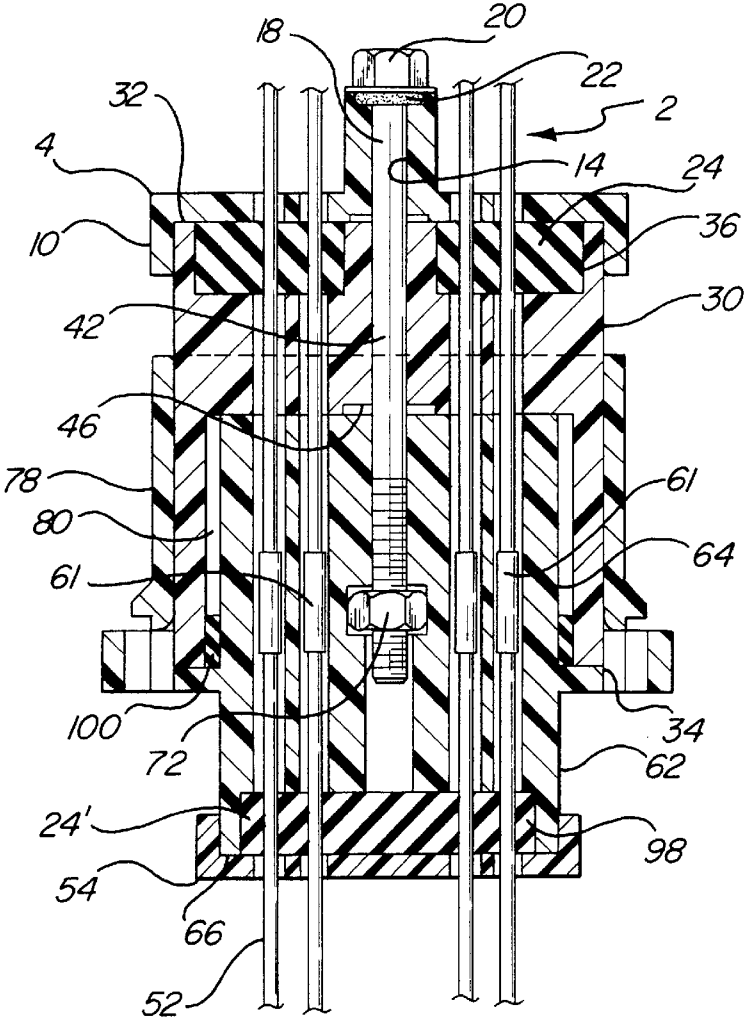
FIG. 4 is a cross-sectional side view of the in-line connector of FIG. 3, assembled.

FIG. 4 illustrates the assembled in-line electrical connector system of FIG. 3. Male-side terminated wires 2 pass through male cover 4, wire seal 24, and into the male terminal housing 30. Wire seal 24 fills cavity 36 in the male terminal housing 30, and cover 4 fits over and around the upper end 32 of housing 30 with bolt 18 extending through bore 42. On the female side of the connector, terminated wires 52 pass through female cover 54 and wire seal 24'. Their terminal ends are electrically connected to male-side wires 2 via terminal accommodating chambers 61 in the female terminal housing 62. Wire seal 24' is inserted into cavity 98 in the lower end 66 of body portion 64 of the female terminal housing 62, and female cover 54 fits over and around lower end 66 of body portion 64. Interface seal 100 is located in slot 80 between sidewall 78 and body portion 64.

The female and male portions of the in-line connector are united as shown. Male terminal housing 30 is inserted into the slot 80 between sidewall 78 and body portion 64 of the female terminal housing 62. The lower end 34 of male housing 30 engages interface seal 100 as bolt 18 is threaded into captive nut 72. The wires from each housing make electrical contact in accommodating chambers 61. The bolt 18 and nut 72 secure male and female housings 30 and 62 together with O-ring 22, wire seals 24, 24' and interface seal 100 making the in-line electrical connection virtually waterproof. Lock washers 16 and 46 in combination with bolt 18 prevent the cover 4, seal 24, and housing 30 from separating during shipping and prior to assembly with housing 62.

In general, the connector system parts described above, other than the bolt, lock washers, nut, O-ring and seals, are injection molded from a suitable plastic.

Figure 5:
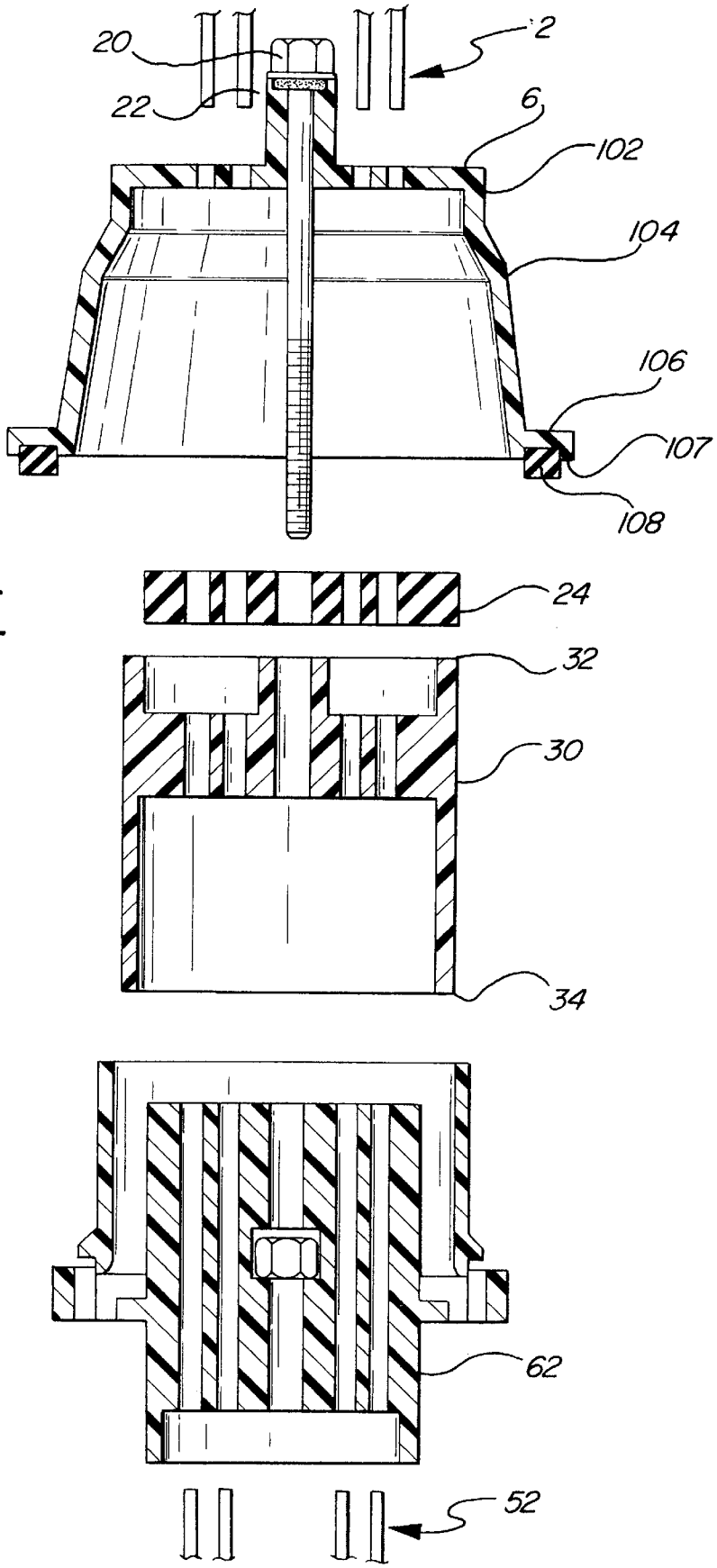
FIG. 5 is a cross-sectional exploded side view of a bulkhead connector assembly according to the invention.

FIG. 5 shows the disassembled parts of an illustrative bulkhead connector according to the invention. The connector system for the bulkhead application is assembled from the same list of parts used for the in-line application described above, except for the male cover on the male housing. The male cover and housing are located on the side of the bulkhead whose environment requires seals for the connector and bulkhead aperture. The male bulkhead cover 102 is similar to male in-line cover 4 except that short flange 10 on the in-line cover is replaced by a longer cup-shaped enclosure 104 with flange 106, which seals against the bulkhead via seal 108 on lower edge 107 of flange 106 in addition to covering the male housing. The junction of bolt head 20 and male cover aperture 14 is preferably sealed by O-ring 22.

On the non-exposed female side of the bulkhead, the interface seal 100, wire seal 24 and cover 54 are typically not required, but are optionally available if the female-side environment warrants a seal.

Figure 6:
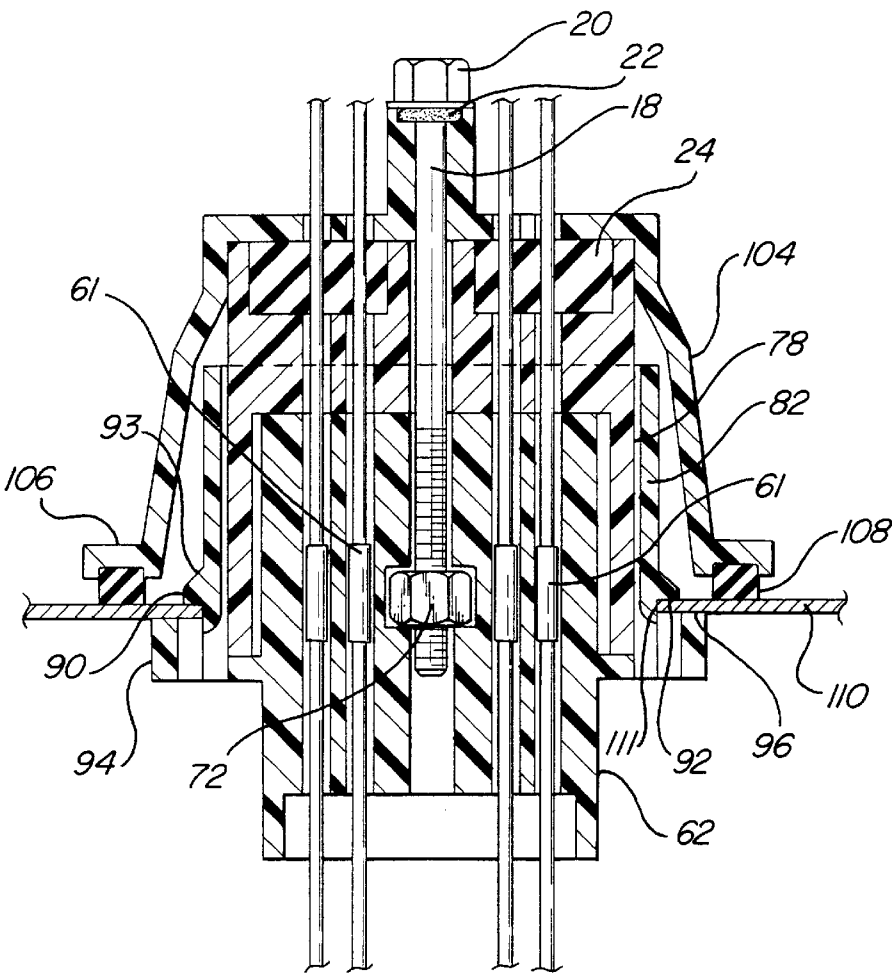
FIG. 6 is a cross-sectional side view of the bulkhead connector of FIG. 5, assembled.

The connector system of FIG. 5 is assembled around a bulkhead 110 as shown in FIG. 6, with the female terminal housing 62 inserted through an aperture 111 in bulkhead 110. When cam surface 93 of projection 90 on each lock arm 82 contacts the edge of the bulkhead aperture, the arm 82 is forced inward toward female housing sidewall 78 until projection 90 is completely through the aperture. The lock arm then springs back to its at-rest position such that the female housing is connected to the bulkhead between contact surface 92 on each lock arm and contact surface 96 on each external support tab 94. This adds stability to the bulkhead seal and ensures proper position for the female housing. The male housing is assembled to the female housing installed in the bulkhead essentially as described above, with male housing sidewall 50 inserted into female housing slot 80 to make the wire terminal connections. When bolt 18 is tightened through captive nut 72, bulkhead seal 108 on the male housing is forced against the male side of bulkhead 110 to seal the connector.

A comparison of the illustrative embodiments of the invention in FIGS. 4 and 6 reveals that, with the exception of the male covers 4, 104, the list of components from which parts are selected for both in-line and bulkhead connector applications is identical. In the bulkhead application a few components associated with the female side of the connector are optional, but if needed are the same components used in the in-line application. Accordingly, a worker at the point of assembly need only decide between two sets of male covers; otherwise, all parts are identical for both in-line and bulkhead applications. Likewise, the manufacturer is presented with reduced tooling and inventory requirements to satisfy both in-line and bulkhead connector applications.

The connector system of the present invention has been illustrated in side view. However, it will be apparent to those skilled in the art that the housings, covers, and seals may take various known shapes in end view without affecting the inventive features described above. For example, housings 30 and 62 can be rectangular or round, with correspondingly shaped covers and seals (although skirt 104 on male bulkhead cover 102 is preferably rounded or circular).

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

The invention claimed is:

1. A modular electrical wire connector system for both in-line and bulkhead applications in automotive vehicles, comprising:

an interchangeable male terminal housing having chambers for receiving a first set of terminated wires, the male housing being adapted to receive a wire seal;

an interchangeable female terminal housing having terminal chambers for receiving a second set of terminated wires, the female housing having a body portion for mating with the male housing such that the first and second sets of terminated wires are electrically connected, the female housing being adapted to receive a wire seal and a female cover, the female housing further including bulkhead retaining means located on the female housing radially outward of the male housing when the male housing is inserted in the female housing, the bulkhead retaining means on the female housing comprising at least one projection and one adjacent tab on a side of the female housing for lockingly engaging a bulkhead when the female housing is inserted through an aperture in the bulkhead; and, a male cover for the male housing, the male cover being selected from one of an in-line cover adapted to mate with the male housing in a sealing fit for an in-line application, and a bulkhead cover adapted to mate with the male housing and engage the bulkhead in a sealing fit for a bulkhead application, wherein the male housing with the in-line cover is adapted to mate with the female housing in a sealing fit in an in-line application, and the male housing with the bulkhead cover is adapted to mate with the female housing in a bulkhead application.

2. The electrical wire connector system of claim 1, wherein the bulkhead cover comprises a cup-shaped cover with an annular skirt portion terminating in a bulkhead sealing surface, the bulkhead sealing surface being brought into sealing contact with one side of the bulkhead when the bulkhead cover and male terminal housing are secured to the female terminal housing.

3. A modular electrical wire connector system for both in-line and bulkhead applications in automotive vehicles, comprising:

a female terminal housing having terminal chambers for receiving a female set of terminated wires, the female terminal housing including bulkhead retaining means for lockingly engaging a bulkhead in a bulkhead application;

a male terminal housing having terminal chambers for receiving a male set of terminated electrical wires, the male terminal housing being adapted to mate with the female terminal housing such that the male and female sets of terminated electrical wires are in electrical contact;

housing interface seal means associated with the male and female terminal housings for forming a seal between the male and female terminal housings when the housings are mated;

female wire seal means capable of being mounted on the female terminal housing to seal the female set of terminated electrical wires;

male wire seal means capable of being mounted on the male terminal housing to seal the male set of terminated wires;

female cover means for securing the female wire seal means to the female terminal housing;

male cover means comprising in-line cover means capable of securing the male wire seal means to the male terminal housing; and male cover means comprising bulkhead cover means having a cup-shaped sidewall and an annular flange capable of securing the male wire seal means to the male terminal housing and for forming a seal with the bulkhead around the male housing; and bolt means for securing the male cover means, the male terminal housing and the female terminal housing to one another; wherein, the male in-line cover means and the male bulkhead cover means are adapted to be interchangeable on the male terminal housing such that the connector system can be adapted between in-line and bulkhead applications by interchanging the in-line and bulkhead cover means on the male housing.

4. The electrical connector system of claim 3, wherein the male bulkhead cover means comprises a cup-shaped cover with an annular skirt portion terminating in a bulkhead sealing surface, the bulkhead sealing surface being brought into sealing contact with one side of the bulkhead when the male bulkhead cover means and male terminal housing are secured to the female terminal housing.

5. The electrical connector system of claim 4, wherein the means for securing the male cover, the male terminal housing, and the female terminal housing comprises bolt means for extending through apertures in the male cover, the male wire seal means, and the male and female terminal housings to engage a nut trapped within the female terminal housing.

6. A modular electrical wire connector system for both in-line and bulkhead applications in automotive vehicles, comprising:

a female terminal housing having terminal chambers for receiving a female set of terminated wires, the female housing having an upper end, a lower end, and bulkhead retaining means for lockingly engaging the bulkhead in a bulkhead application, the lower end of the female housing being adapted to receive a female wire seal and a female cover over the wire seal;

a male terminal housing having terminal chambers for receiving a male set of terminated electrical wires, the male terminal housing having an upper end and a lower end, the male terminal housing being adapted to mate with the female terminal housing such that the male and female sets of terminated electrical wires are in electrical contact, the male terminal housing further being adapted at its upper end to receive a male wire seal and a male cover over the wire seal;

an in-line male cover adapted to cover and secure the male wire seal at the upper end of the male terminal housing for an in-line application;

a bulkhead male cover adapted to cover and secure the male wire seal at the upper end or the male terminal housing for a bulkhead application, the male bulkhead cover further including a cup-shaped sidewall and an annular flange extending around the male terminal housing to engage the bulkhead in a sealing fit in a bulkhead application;

housing interface seal means associated with the lower end of the male terminal housing and the upper end of the female terminal housing to form a seal between the male and female terminal housings when the housings are mated;

bolt means for securing the in-line male cover, the male terminal housing and the female terminal housing to one another in an in-line application, and for securing the bulkhead male cover, the male terminal housing and the female terminal housing to one another in a bulkhead application, such that the connector system can be adapted between in-line and bulkhead applications by interchanging the in-line and bulkhead male covers on the male housing.

* * * * *

UNITED STATES PATENT AND TRADEMARK OFFICE

CERTIFICATE OF CORRECTION

PATENT NO. : 5,803,763

DATED : September 8, 1998

INVENTOR(S) : Grant

It is certified that error appears in the above-indentified patent and that said Letters Patent is hereby corrected as shown below:

On the title page, item [54], and col. 1.
In the Title, delete "CONNECTION" AND insert --CONNECTOR--.

Column 5, line 45, delete "chambers" AND insert --terminal chambers.

Signed and Sealed this

Twenty-third Day of February, 1999

*Attest:*

Q. TODD DICKINSON

*Attesting Officer*

*Acting Commissioner of Patents and Trademarks*